US006497525B1

(12) United States Patent
Huang

(10) Patent No.: US 6,497,525 B1
(45) Date of Patent: Dec. 24, 2002

(54) MOP WITH A LIQUID SPRAYING DEVICE

(76) Inventor: Chiu-Yun Huang, No. 20, Industrial Park 35Th. Road, Taichung City (TW)

( * ) Notice: Subject to any disclaimer, the term of this patent is extended or adjusted under 35 U.S.C. 154(b) by 0 days.

(21) Appl. No.: 10/117,753

(22) Filed: Apr. 5, 2002

(51) Int. Cl.[7] ..... A47L 1/08
(52) U.S. Cl. ..... 401/138; 401/140; 401/137
(58) Field of Search ..... 401/137, 138, 401/139, 140, 268, 270, 275, 278, 279, 282

(56) References Cited

U.S. PATENT DOCUMENTS 2,228,574 A * 1/1941 Lowe ..... 401/138
2,815,522 A * 12/1957 Hexter ..... 401/140
3,457,016 A * 7/1969 Gotberg ..... 401/140
4,863,299 A * 9/1989 Osberghaus et al. ..... 401/140
6,325,563 B1 * 12/2001 Matechuk ..... 401/140

* cited by examiner

*Primary Examiner*—David J. Walczak
(74) *Attorney, Agent, or Firm*—Connolly Bove Lodge & Hutz

(57) ABSTRACT

A mop with a liquid spraying device includes a tubular shaft, a mop head mounted on a lower end of the tubular shaft, a driving device reciprocally received in the tubular shaft, and the liquid spraying device mounted on the tubular shaft and driven by the driving device. The liquid spraying device includes a container attached to the tubular shaft for containing the liquid, such as water or cleaner. The driving device drives the liquid spraying device to compress the liquid in the container and the compressed liquid sprays out from a nozzle that is mounted on the mop head for promoting the cleaning effect of the mop.

8 Claims, 4 Drawing Sheets

MOP WITH A LIQUID SPRAYING DEVICE

BACKGROUND OF THE INVENTION

1. Field of the Invention

The present invention relates to a mop, and more particularly to a mop with a liquid spraying device.

2. Description of Related Art

A conventional mop in accordance with the prior art comprises shaft and a mop head pivotally mounted on a lower end of the shaft. The user must wet the mop head and sprinkle cleaner on the floor for clean the floor. However, such a method of cleaning floor wastes a lot of time.

Consequently, a mop with a liquid spraying device is marketed. The conventional mop with a liquid spraying device uses a battery and an electric pump for pumping water or cleaner from a container to promote the cleaning effect. However, the electric element will make the mop in a high price and need to be kept in a good repair. It is an inconvenient design.

The present invention has arisen to mitigate and/or obviate the disadvantages of the conventional mop with a liquid spraying device.

SUMMARY OF THE INVENTION

The main objective of the present invention is to provide an improved mop that has a liquid spraying device for promoting cleaning effect of the mop.

To achieve the objective, the mop with a liquid spraying device in accordance with the present invention comprises a tubular shaft, a mop head mounted on a lower end of the tubular shaft, a driving device reciprocally received in the tubular shaft, and the liquid spraying device mounted on the tubular shaft and driven by the driving device. The liquid spraying device includes a container attached to the tubular shaft for containing the liquid, such as water or cleaner. The driving device drives the liquid spraying device to compress the liquid in the container and the compressed liquid sprays out from a nozzle that is mounted on the mop head.

Further benefits and advantages of the present invention will become apparent after a careful reading of the detailed description with appropriate reference to the accompanying drawings.

DETAILED DESCRIPTION OF THE INVENTION

Figure 1:
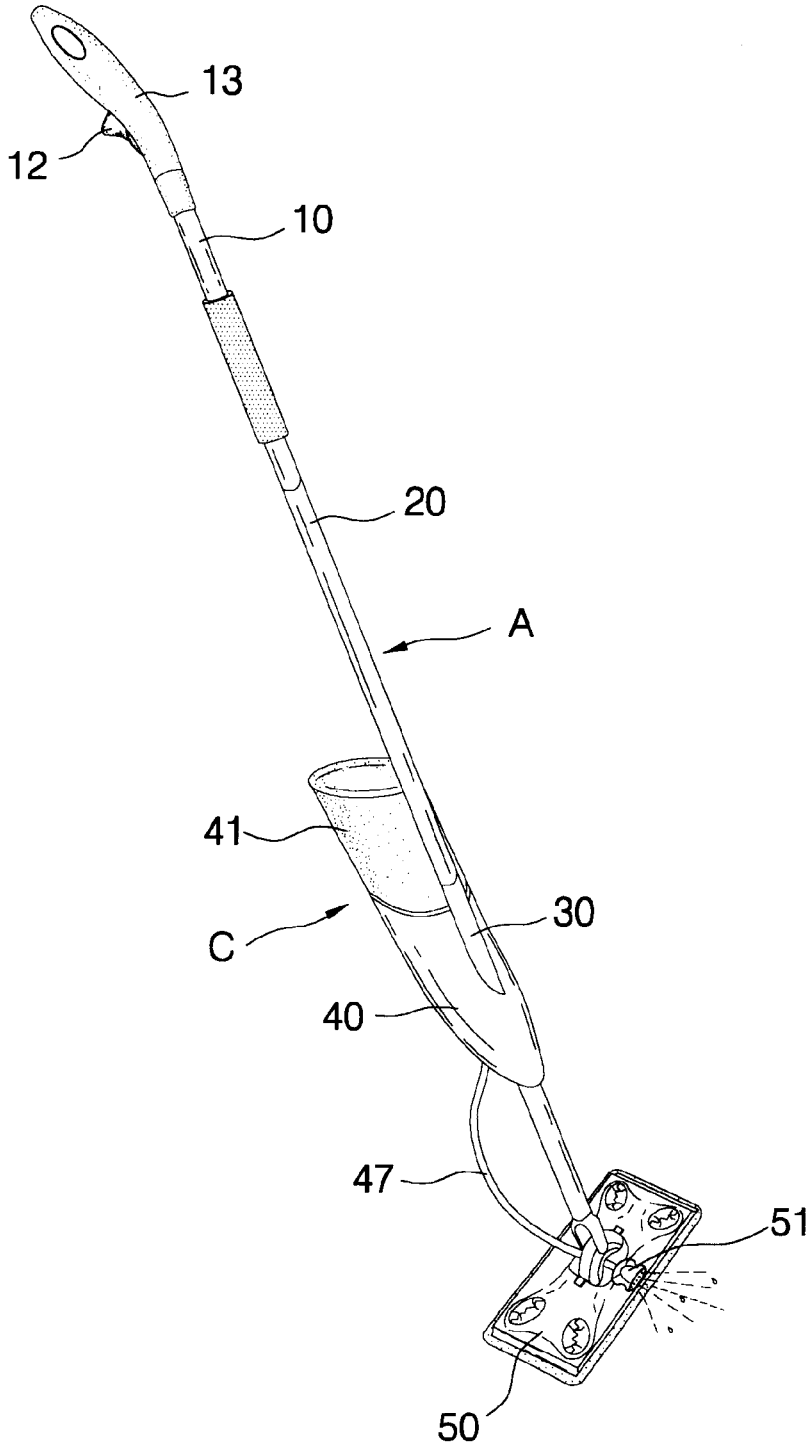
FIG. 1 is a perspective view of a mop with a liquid spraying device in accordance with the present invention.
Figure 2:
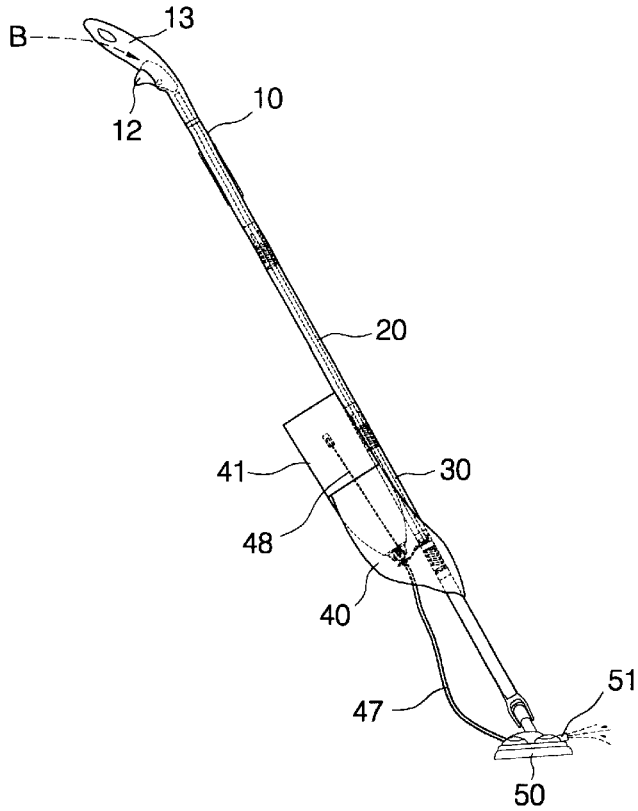
FIG. 2 is a side plan view of the mop with a liquid spraying device in FIG. 1.

With reference to the drawings and initially to FIGS. 1 and 2, a mop with a liquid spraying device in accordance with the present invention comprises a tubular shaft (A), a driving device (B) received in the tubular shaft (A) and a mop head (50) pivotally mounted on a lower end of the tubular shaft (A). The liquid spraying device (C) is mounted on the tubular shaft (A) and driven by the driving device (B).

Figure 3:
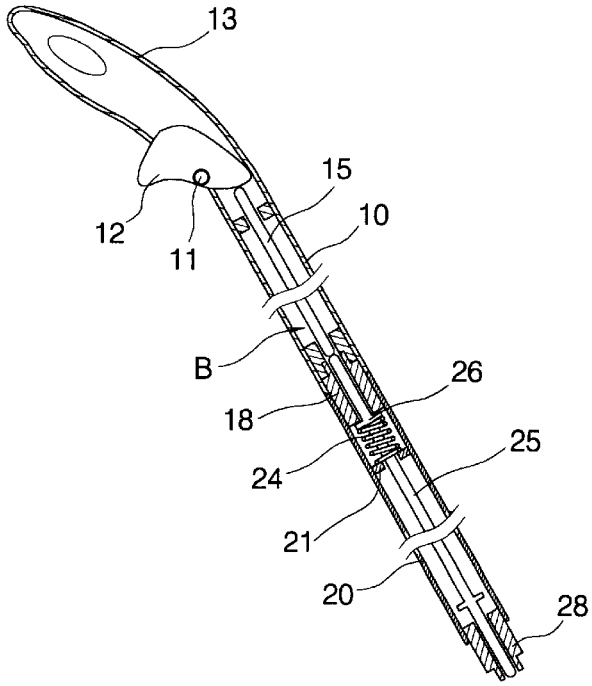
FIG. 3 is a partial cross sectional side plan view of the mop with a liquid spraying device in FIG. 1.
Figure 5:
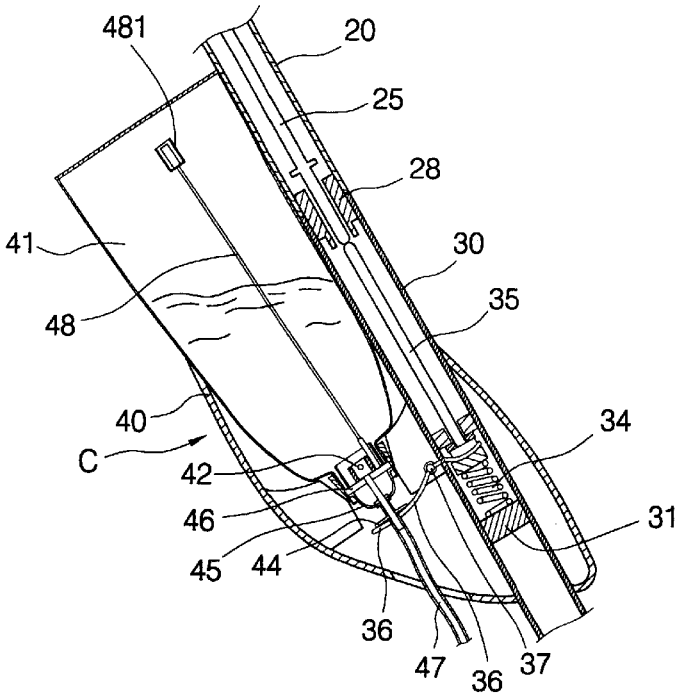
FIG. 5 is a partial cross sectional side plan view of the liquid spraying device in FIG. 1.

With reference to FIGS. 2, 3 and 5, the tubular shaft (A) comprises a first sleeve (10), a second sleeve (20) and a third sleeve (30) connected to one another to form the tubular shaft (A). An opening (not numbered) is defined in the first sleeve (10) of the tubular shaft (A). A handle (13) is attached to an upper end of the first sleeve (10) for user to operate the mop. A first connector (18) is partially inserted into a lower end of the first sleeve (10) of the tubular shaft (A) and partially received in an upper end of the second sleeve (20) of the tubular shaft (A) for connecting the first sleeve (10) and the second sleeve (20) of the tubular shaft (A). The second sleeve (20) of the tubular shaft (A) has a protrusion (21) radially extending from an inner periphery of the second sleeve (20) of the tubular shaft (A). A second connector (28) is partially inserted into a lower end of the second sleeve (20) of the tubular shaft (A) and partially received in an upper end of the third sleeve (30) for connecting the second sleeve (20) and the third sleeve (30) of the tubular shaft (A). The third sleeve (30) of the tubular shaft (A) has a stopper (31) securely received in the third sleeve (30) of the tubular shaft (A) and the mop head (50) is pivotally mounted on a lower end of the third sleeve (30) of the tubular shaft (A).

The driving device (B) comprises a cam (12) pivotally mounted in the first sleeve (10) by a pivot pin (11) and extending through the opening in the first sleeve (10). A first linkage (15) is reciprocally received in the first sleeve (10). The first linkage (15) has an upper end abutting the cam (12). A second linkage (25) is reciprocally received in the second sleeve (20). The second linkage (25) has an upper end extending into the first connector (18) and longitudinally abutting a lower end of the first, linkage (15). The second linkage (25) has a lower end extending through the second connector (28). The second linkage (25) has a shoulder (26) radially extending from an outer periphery of the second linkage (25) under the first connector (18). A first spring (24) is compressively sleeved around the second linkage (25) between the shoulder (26) and the protrusion (21) of the second sleeve (20). A third linkage (35) is reciprocally received in the third sleeve (30). The third linkage (35) has an upper end longitudinally abutting the lower end of the second linkage (25). A second spring (34) is compressively mounted between the third linkage (35) and the stopper (31) in the third sleeve (30).

Figure 6:
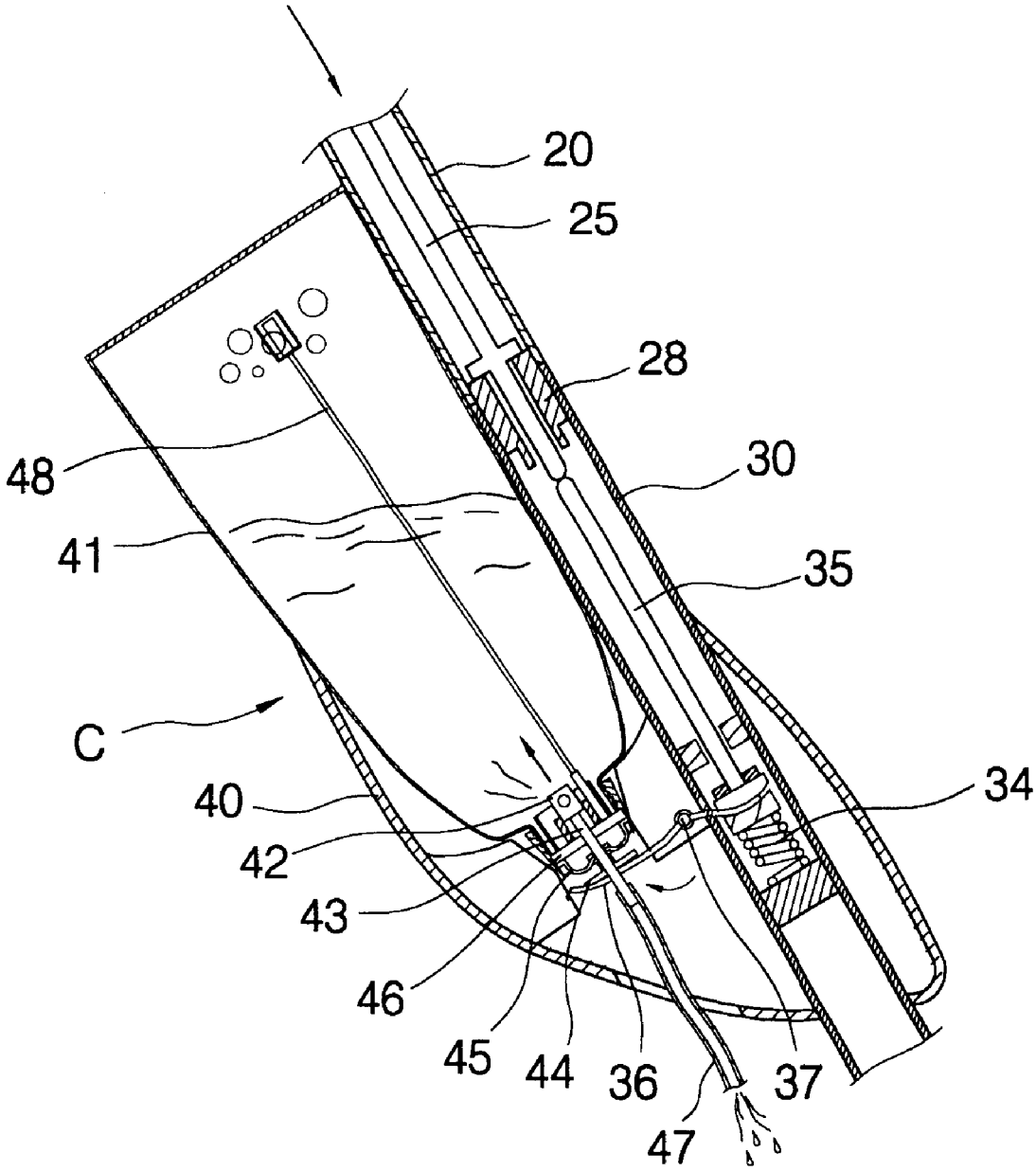
FIG. 6 is a partially operational side plan view in cross section of the liquid spraying device in FIG. 5.

With reference to FIGS. 5 and 6, the liquid spraying device (C) comprises a bracket (40) mounted on the third sleeve (30) of the tubular shaft (A). A container (41) is, partially and detachably mounted on the bracket (40) for containing liquid, such as water or cleaner. The container (41) has a through hole (not numbered) defined in a bottom thereof. A first check valve (42) is movably received in the through hole of the container (41). A conduit (43) is connected to the first check valve (42). The conduit (43) selectively communicates with the container (41) and extends through the through hole of the container (41). A sealant (46) is securely mounted in the through hole in the container (41) to close the through hole in the container (41). The first check valve (42) selectively abuts the sealant (46) and prevents the liquid from flowing back to the container. A flexible cover (45) is mounted on the through hole in the container (41). The conduit (43) securely extends through the sealant (46) and the flexible cover (45). A driving plate (44) radially extends from an outer periphery of the conduit

(43) under the flexible cover (45). A pawl (36) is pivotally mounted on the bracket (40) by a pivot (37). The pawl (36) has a first end abutting a bottom of the driving plate (44) to upwardly push the conduit (43) and the first check valve (42) to compress the liquid in the container (41) and a second end extending into the third sleeve (30) and situated between a lower end of the third linkage (35) and the second spring (34). Further with reference to the FIG. 1, a nozzle (51) is fixedly mounted on the mop head (50). A pipe (47) is attached to and communicates with the conduit (43) and the nozzle (51). A windpipe (48) is attached to the first check valve (42) and communicates with the outer periphery of the container (41) for balancing the pressure in the container (41) and the atmosphere. A second check valve (481) is attached to a free end of the windpipe (48) to prevent the air or the liquid in the container (41) from flowing out from the windpipe (48) during compression.

Figure 4:
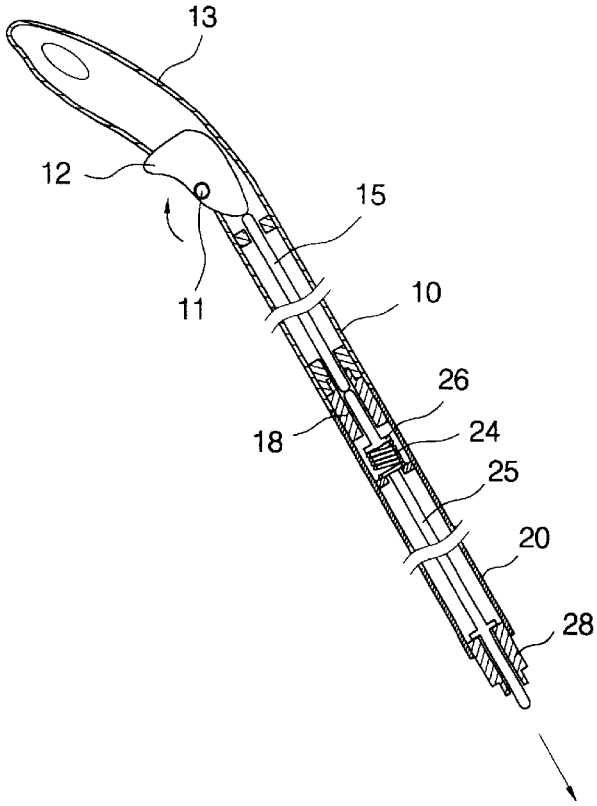
FIG. 4 is a partially operational side plan view in cross section of the mop with a liquid spraying device in FIG. 3.

To operate the mop with a liquid spraying device in accordance with the present invention, with reference to FIGS. 1, 4 and 6, the linkages (15, 25, 35) are moved to downward push the second end of the pawl (36), and the first spring (24) and the second spring (34) are compressed when the cam (12) is pressed and rotated due to the pivot pin (11). Consequently, the first end of the pawl (36) upwardly pushes the conduit (43) and the first check valve (42) to compress the liquid in the container (41) such that the compressed liquid flows passing the conduit (43) into the pipe (47) and sprays out from the nozzle (51) to promote the cleaning effect of the mop. The air flows into the container (41) via the windpipe (48) and the second check valve (481) to balance the pressure in the container (41) and the atmosphere when the cam (12) automatically moves to the original position due to a restitute force of the first spring (24) and the second spring (34).

As described above, the battery and the electric pump of the conventional mop with a liquid spraying device are unnecessary to the mop with a liquid spraying device in accordance with the present invention so that the manufacturing cost is reduced. Furthermore, the elements of the present invention are driven by a simple mechanical type so that the mop of the present invention is very easy to be kept in a good repair.

Although the invention has been explained in relation to its preferred embodiment, it is to be understood that many other possible modifications and variations can be made without departing from the spirit and scope of the invention as hereinafter claimed.

What is claimed is:

1. A mop with a liquid spraying device, comprising:

a tubular shaft including a first sleeve, a second sleeve and a third sleeve longitudinally connected to one another to form the tubular shaft;

a mop head pivotally mounted on a lower end of the tubular shaft;

a driving device received in the tubular shaft and including:

a cam pivotally and partially mounted in the first sleeve, the cam extending through the first sleeve for user to operate;

a first linkage reciprocally received in the first sleeve, the first linkage having an upper end abutting the cam;

a second linkage reciprocally received in the second sleeve and having an upper end longitudinally abutting a lower end of the first linkage; and a third linkage reciprocally received in the third sleeve and having an upper end longitudinally abutting a lower end of the second linkage; and the liquid spraying device mounted on the third sleeve and including:

a bracket secured on the third sleeve;

a container partially and detachably mounted in the bracket for containing the liquid, the container having a through hole defined in a bottom thereof;

a sealant mounted in the through hole for closing the through hole in the container;

a first check valve selectively abutting the sealant to prevent the liquid from flowing back to the container;

a conduit securely extending through the sealant and connected to the first check valve, the conduit selectively communicating with the container;

a pawl pivotally mounted on the bracket, the pawl having a first end connected to the conduit to upwardly drive the conduit to compress the liquid in the container and a second end connected to a lower end of the third linkage so that the driving device drives the liquid spraying device;

a nozzle mounted on the mop head to allow the compressed liquid in the container to spray out of the liquid spraying device; and a pipe having to opposite ends respectively connected to the conduit and the nozzle.

2. The mop with a liquid spraying device as claimed in claim 1, wherein the second sleeve has a protrusion radially extending from an inner periphery of the second sleeve, the second linkage has a shoulder radially extending from an outer periphery of the second linkage and a first spring is compressively sleeved around the second linkage between the protrusion and the shoulder.

3. The mop with a liquid spraying device as claimed in claim 1, wherein the first linkage, the second linkage and the third linkage are synchronously moved.

4. The mop with a liquid spraying device as claimed in claim 1, wherein the pawl is pivotally mounted on the bracket by a pivot.

5. The mop with a liquid spraying device as claimed in claim 1, wherein the third sleeve comprises a stopper securely received therein and a second spring is compressively mounted between the stopper and the second end of the pawl.

6. The mop with a liquid spraying device as claimed in claim 1, wherein the liquid spraying device comprises a flexible cover mounted on the container for closing the through hole in the container and the conduit securely extends through the flexible cover of the liquid spraying device.

7. The mop with a liquid spraying device as claimed in claim 1, wherein the liquid spraying device comprises a windpipe attached to the first check valve and communicating with the outer periphery of the container for balancing the pressure in the container and the atmosphere.

8. The mop with a liquid spraying device as claimed in claim 7, wherein the windpipe comprises a second check valve attached to a free end of the windpipe to prevent the air and the liquid in the container from flowing out from the windpipe during compression.

* * * * *